US011026487B2

(12) United States Patent
Ritter

(10) Patent No.: US 11,026,487 B2
(45) Date of Patent: Jun. 8, 2021

(54) SEPARABLE QUAD CANE ASSEMBLY AND METHOD OF NESTING AND PACKAGING THE SAME

(71) Applicant: Medline Industries, Inc, Northfield, IL (US)

(72) Inventor: Joseph Ritter, Arlington Heights, IL (US)

(73) Assignee: Medline Industries, Inc., Northfield, IL (US)

( * ) Notice: Subject to any disclaimer, the term of this patent is extended or adjusted under 35 U.S.C. 154(b) by 133 days.

(21) Appl. No.: 16/380,900

(22) Filed: Apr. 10, 2019

(65) Prior Publication Data

US 2020/0221834 A1 Jul. 16, 2020

Related U.S. Application Data

(60) Provisional application No. 62/792,817, filed on Jan. 15, 2019.

(51) Int. Cl.
*A45B 9/04* (2006.01)
*A45B 7/00* (2006.01)
(Continued)

(52) U.S. Cl.
CPC ..... *A45B 9/04* (2013.01); *A45B 7/005* (2013.01); *A45B 9/02* (2013.01); *B65B 5/04* (2013.01);
(Continued)

(58) Field of Classification Search
CPC ..... B65D 75/14; B65D 73/0085; B65D 73/0078; B65D 85/20; B65D 5/2052;
(Continued)

(56) References Cited

U.S. PATENT DOCUMENTS 1,956,642 A * 5/1934 Einson ..... B65D 5/16 206/45.25
2,859,866 A * 11/1958 Altenbern ..... B65D 75/14 206/362.4
(Continued)

FOREIGN PATENT DOCUMENTS

EP 841054 5/1998

OTHER PUBLICATIONS

Czyz, Steven , "NonFinal Office Action", U.S. Appl. No. 29/692,132, filed May 22, 2019; dated Aug. 15, 2019.

*Primary Examiner* — Chun Hoi Cheung
(74) *Attorney, Agent, or Firm* — Philip H. Burrus, IV

(57) ABSTRACT

A package (200) for a selectively separable quad cane assembly can include an enclosed rectangular box (500), with a front face (201) defining an aperture (224) that is centrally located along a height (225) of the front face and offset from a medial line (227) defined by the front face. An upper face (205) can define a two-sided aperture (222) at a corner of the upper face, while a lower face (206) defines a peninsular aperture (221) that is centrally located along an edge (223) of the lower face. In the package, the aperture can concentrically circumscribe an a cane-receiving conduit (125) of a quadspider (221) of the cane, while an apex (501) of a gooseneck (108) of the cane is aligned with the two-sided aperture of the upper face and the lower leg is aligned with the peninsular aperture of the lower face.

17 Claims, 8 Drawing Sheets

(51) Int. Cl.
*A45B 9/02* (2006.01)
*B65B 5/04* (2006.01)
*B65D 75/14* (2006.01)
*A45B 9/00* (2006.01)

(52) U.S. Cl.
CPC ..... *B65D 75/14* (2013.01); *A45B 2009/002* (2013.01); *A45B 2009/007* (2013.01)

(58) Field of Classification Search
CPC ..... B65D 71/12; B65D 2571/00123; A45B 9/04; A45B 7/00; A45B 7/005; A45B 2009/007; A45B 2009/002; A45B 9/02
USPC ..... 206/779, 775, 815, 495, 493; 229/103.2, 229/103.3
See application file for complete search history.

(56) References Cited

U.S. PATENT DOCUMENTS

D187,450 S 3/1960 Maxwell et al.
D229,728 S 12/1973 Morton et al.
D230,531 S 2/1974 Morton et al.
3,946,936 A * 3/1976 Brown ..... B65D 5/4208 229/117.18
4,044,784 A 8/1977 Smith
D272,677 S 2/1984 Bove
4,528,998 A 7/1985 Gamm
D290,186 S 6/1987 Meunchen
4,997,001 A * 3/1991 DiCarlo ..... A45B 9/04 135/65
D324,946 S 3/1992 Karten
5,238,013 A 8/1993 Battiston
5,331,990 A 7/1994 Hall et al.
5,341,923 A * 8/1994 Arasim ..... B65D 5/4208 206/214
5,390,687 A * 2/1995 Tsai ..... A61H 3/02 135/65
5,640,985 A 6/1997 Snyder et al.
5,697,502 A * 12/1997 Linz ..... B65D 73/0085 206/779
5,806,548 A * 9/1998 Goldstein ..... A61H 3/02 135/65
D408,126 S 4/1999 Hunnicutt et al.
D411,653 S 6/1999 Richey
5,941,262 A 8/1999 Tschirhart
D417,068 S 11/1999 Swercheck et al.
D419,288 S 1/2000 Hartfield
6,158,453 A 12/2000 Nasco
D522,232 S 6/2006 Karasin et al.
D528,780 S 9/2006 Karasin et al.
D539,523 S 4/2007 Wu
D552,245 S 10/2007 Davis
D552,340 S 10/2007 Graves et al.
D590,591 S 4/2009 Yates
D595,501 S 7/2009 Sawada
D600,002 S 9/2009 Fulkerson
7,600,523 B1 10/2009 Hawkesworth
D621,601 S 8/2010 Greissinger
D632,069 S 2/2011 Thiessens
D671,308 S 11/2012 Treanor
8,453,661 B2 6/2013 Hutt
8,607,809 B2 * 12/2013 Jordan ..... A45B 7/005 135/82
8,939,285 B2 * 1/2015 Trontel ..... B65D 73/0064 206/335
9,675,515 B2 6/2017 Chou et al.
9,795,530 B2 10/2017 Jordan et al.
D818,699 S 5/2018 Lee
10,186,129 B2 1/2019 Hood
10,661,959 B2 * 5/2020 Martin ..... A45B 1/04
2016/0300469 A1 10/2016 Hood
2019/0092544 A1 * 3/2019 Martin ..... B65D 73/0085

* cited by examiner

SEPARABLE QUAD CANE ASSEMBLY AND METHOD OF NESTING AND PACKAGING THE SAME

CROSS REFERENCE TO PRIOR APPLICATIONS

This application claims priority and benefit under 35 U.S.C. § 119(e) from U.S. Provisional Application No. 62/792,817, filed Jan. 15, 2019, which is incorporated by reference for all purposes.

BACKGROUND

Technical Field

This disclosure relates generally to rehabilitation devices, and more particularly to canes.

Background Art

People sometimes require support devices during rehabilitation of injuries to hips and legs. For example, when a leg or hip is injured, a person may use a cane while the injury heals. A person can use a cane to reduce the amount of weight loading an injured body portion. A person also uses a cane to increase stability and balance when a lower limb or connecting part is injured.

Some factors used to select an appropriate cane include cane cost, cane weight, cane adjustability, cane comfort, and cane stability. These features can be difficult to inspect in a retail environment, as there is little shelf space available for large canes and canes. It would be advantageous to have an improved cane that could be configured in a more compact package.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
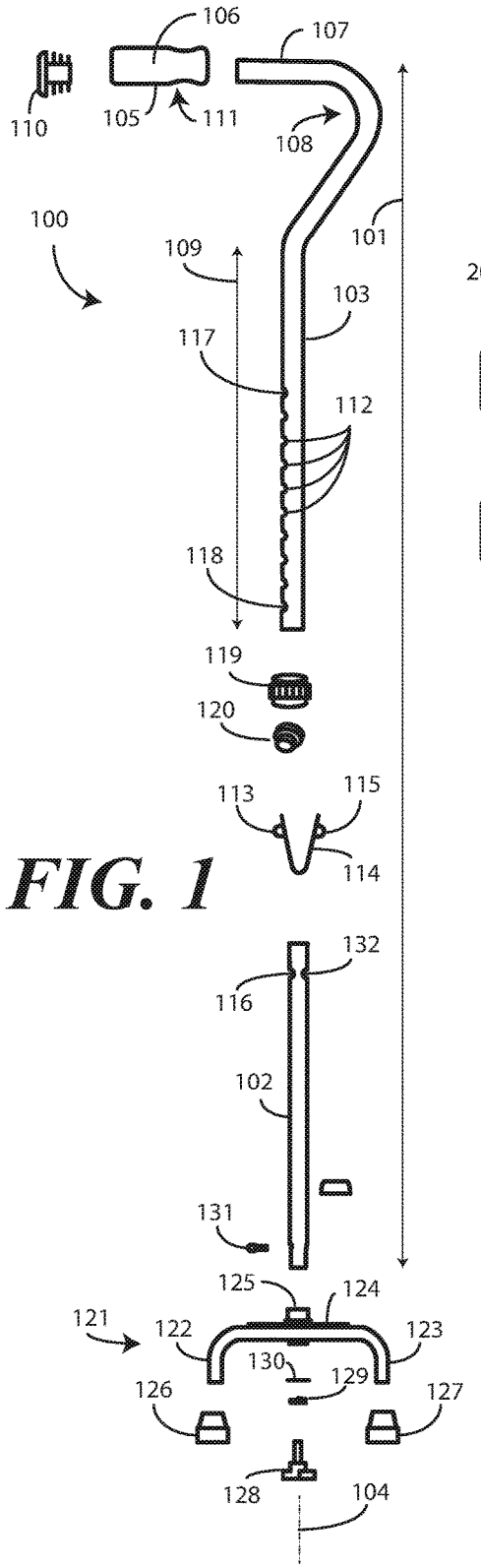
FIG. 1 illustrates an exploded view of one explanatory cane in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

As used herein, components may be "operatively coupled" when information can be sent between such components, even though there may be one or more intermediate or intervening components between, or along the connection path. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%.

The term "coupled" as used herein is defined as connected, although not necessarily directly and not necessarily mechanically. Also, reference designators shown herein in parenthesis indicate components shown in a figure other than the one in discussion. For example, talking about a device (10) while discussing figure A would refer to an element, 10, shown in figure other than figure A.

As noted above, factors used to select an appropriate cane include cane cost, cane weight, cane adjustability, cane comfort, and cane stability. These features can be difficult to inspect in a retail environment, as there is little shelf space available for large canes and canes. This is especially true with specialized canes such as the "quad cane" or "quadspider" cane.

While a cane can be placed in a bucket or laid on a shelf, canes with more bulky attachments, such as a multi-leg base, have awkward, asymmetrical shape that is not conducive to lying on a shelf. Consequently, in retail environments a retailer may have only one quad cane available for inspection. Since they are generally left to stand on the floor, when one customer tries it out, they frequently leave it in another location of the store. This results in a shopper having to search the store for a cane, or being left unable to inspect the cane prior to purchase.

Compounding matters, prior art quadspider canes are shipped from the manufacturer in a fully assembled, often welded together state. These canes are placed in large boxes where the cane consumes less than ten percent of the volume of the box. Not only is this a tremendous waste of packaging, it becomes a waste of space in a shipping container, on a truck, and on a retail shelf as well. The boxes are too large for retailers to place on a shelf. Consequently, retailers frequently discard the boxing and leave one "demo" model on the floor, which leads to the aforementioned problem of the cane "walking off."

The inventors have discovered that this constitutes a major problem with reference to quad cane sales. Many retailers, including drug stores, big box stores, and other retailers generally do not put quad canes on their shelves. If the quad cane is in it's packaging, the accompanying packaging is just too large. If the quad cane has been removed from it's packaging, the cane becomes asymmetrical and unwieldy.

Embodiments of the present disclosure solve this problem by providing a separable quad cane design that fits into compact packaging measuring as little as 6.75 inches by 8.5 inches when viewed in a front elevation view. The packaging of the separable quad cane can be placed flat on a shelf in one embodiment. Alternatively, the packaging can simply be hung from a hook. Advantageously, embodiments of the disclosure provide a quad cane that can be boxed in a package having dimensions less than a letter-sized sheet of paper. Embodiments of the disclosure further remove the bulky asymmetries associated prior art, fully assembled canes. Embodiments of the disclosure can reduce the packaging material required to package a quad cane by a factor of five or more.

Embodiments of the disclosure provide a separable quad cane wherein the quadspider can be quickly and easily detached from the upright portion of the cane. In one or more embodiments, a simple winged thumbscrew is all that is needed to couple the upright shaft of the cane to the quadspider. This detachability allows the quadspider to be placed atop the upper shaft of the cane for packaging. A small box then envelops the quadspider and the portion of the cane shaft spanning the quadspider. The crook of the cane emanates from the top of the package, while the lower portion of the shaft extends from the bottom of the packaging. A hang tab can extend from the top of the packaging to allow the assembly to be hung from a hook. Alternatively, the packaging can be laid flat on a retail shelf. Embodiments of the disclosure advantageously minimize container utilization by approximately sixty percent in some embodiments.

In one or more embodiments, a package for a selectively separable quad cane assembly includes a package that is folded to define an enclosed box. In one or more embodiments, the box is substantially rectangular.

In one or more embodiments, a front face of the box defines an aperture that is centrally located along a height of the front face and offset from a medial line defined by the front face. An upper face defines a two-sided aperture at a corner of the upper face, while a lower face defining a peninsular aperture that is centrally located along an edge of the lower face.

In one or more embodiments, the selectively separable quad cane assembly comprises an upper portion defining a gooseneck and a lower leg telescopically engaging an upper leg and a quadspider comprising a cane-receiving conduit disposed along a substantially planar plate. In one or more embodiments, when the separated quad cane is placed in the package, the aperture concentrically circumscribes the cane-receiving conduit. In one or more embodiments, an apex of the gooseneck is aligned with the two-sided aperture of the upper face, while the lower leg is aligned with the peninsular aperture of the lower face.

So as to be available for presentation from a hanger, in one embodiment at least one hang flap extends from a side of the enclosed rectangular box. The at least one hang flap can define one or more apertures, which can include a hanging aperture. A retention device can pass through the one or more apertures and retaining the gooseneck against the hang flap.

Embodiments of the present disclosure make it economically possible for retailers to place quad canes either on their shelves, or on a hook on a wall, by providing a quad cane assembly that, when in its separated and packaged state, is dramatically smaller than are prior art quad canes. In one embodiment, this reduction in dimension is provided by way of the fact that the quadspider can be separated from the upright shaft, thereby allowing the quad cane to be collapsed for stowage and packaging. This results in a sixty or more percent reduction in size over prior art designs when in the collapsed configuration. Embodiments of the disclosure contemplate that many retailers are more than willing to put packages having these reduced dimensions on their shelves. Accordingly, embodiments of the disclosure provide a benefit to both consumer and retailer. The consumer is benefitted by having an increased number of retail outlets in which to purchase a quad cane. The consumer is additionally benefitted by having a quad cane that is far smaller than prior art designs when in the collapsed position. The retailer benefits because they have a new product that can be displayed on shelves, or hung from a hook, without consuming too much space.

Turning now to FIG. 1 illustrated therein is one embodiment of a cane 100 in accordance with one or more embodiments of the disclosure. In one or more embodiments, an upper portion 101 of the cane 100 defines a "single tube" assembly comprising a substantially vertical, lower leg 102, which nests within, and can be extended from and upper leg 103. The upper leg 103 includes a substantially vertical portion 109, a gooseneck 108, and a substantially horizontal portion 107. In the illustrative embodiment of FIG. 1, the gooseneck 108 couples the substantially vertical portion 109 to the substantially horizontal portion 107.

In one or more embodiments, the substantially vertical, lower leg 102 and the upper leg 103 can each be manufactured from metal, wood, fiberglass, carbon fiber, aluminum, or other materials. Illustrating by example, in one embodiment the substantially vertical, lower leg 102 and the upper leg 103 are manufactured from steel. The cane 100 is generally designed, in comparison to other available canes, to have a low cost and low weight, and, further, to provide improved convenience, comfort, and stability for the user.

In one or more embodiments, the cane 100 provides a user with adequate support, having at least a 300-pound weight-bearing capacity. The single tube defined by the substantially vertical, lower leg 102 and the upper leg 103 is the main weight-receiving member of the cane 100.

In this illustrative embodiment, each of the substantially vertical, lower leg 102 and the substantially vertical portion 109 of the upper leg 103 are both disposed along a central axis 104. In one embodiment the substantially vertical, lower leg 102 is a telescoping leg, in that it can extend downwardly along the central axis 104 from the substantially vertical portion 109 of the upper leg 103 to extend the overall length of the cane 100.

In addition to the substantially vertical, lower leg 102 and the upper leg 103, in one or more embodiments the cane 100 also includes a grip assembly 105. The grip assembly 105 comprises a grip 106 that engages the horizontal portion 107 of the upper leg 103. An optional grip plug 110 can be used to retain the grip 106 to the horizontal portion 107 of the upper leg 103 in one embodiment. In other embodiments, the grip plug 110 will be omitted, with the grip 106 either being hollow at its rear end or having an end that spans the rear end of the horizontal portion 107 of the upper leg 103.

In one or more embodiments, the grip 106 serves as a soft, comfortable covering for the horizontal portion 107 of the upper leg 103. For example, the grip 106 can comprises a rubber foam or sponge to make grasping the horizontal portion 107 of the upper leg 103 softer and more comfortable for a user. Perspiration absorbing materials, antimicrobial materials, friction increasing materials, or other materials can be applied to the grip 106 as well.

In one embodiment, the grip 106 comprises a textured rubber material that is strong and durable. Optionally, the grip 106 is water resistant. The rubber material can be, for example, a petroleum-based rubber or a foam rubber. The grip 106 can also include an inner member that can optionally be a hollow cylinder. The inner member may be comprised of plastic or any other type of material. In general, the inner member provides support and rigidity, and the outer rubber member provides a more comfortable feeling for the user.

In one embodiment, the grip 106 is contoured so as to better fit a user's hand. For example, in one embodiment, the grip 106 has an arcuate contour 111 that corresponds to the placement of a web of a user's hand when placed on the grip 106. In other embodiments, the grip 106 can have a differently shaped surface. For example, finger indentations could be molded into the grip 106. Similarly, other shapes and contours could be molded into the grip 106 to accommodate a user's palm, heel of hand, or thumb. Other configurations of the outer surface of the grip 106 will be obvious to those of ordinary skill in the art having the benefit of this disclosure.

In one or more embodiments, the horizontal portion 107 of the upper leg 103 is coupled to the substantially vertical portion 109 by a gooseneck 108. The horizontal portion 107, the substantially vertical portion 109, and the gooseneck 108 are configured as a unitary, singular part in one or more embodiments. For example, a single tube of steel can be contoured so as to define the horizontal portion 107, the substantially vertical portion 109, and the gooseneck 108. In one or more embodiments the gooseneck 108 defines an ergonomically curved shape that allows a user's hand to grasp the grip 106 without interference from the substantially vertical portion 109 of the upper leg 103. In this illustrative embodiment, the gooseneck 108 extends from the substantially vertical portion 109 and defines an obtuse angle with the substantially vertical portion 109 of the upper leg 103. In other embodiments, the substantially vertical portion 109 and the substantially horizontal portion 107 can be substantially orthogonal relative to teach other, with the gooseneck 108 omitted. Other configurations will be obvious to those of ordinary skill in the art having the benefit of this disclosure.

The extension of the substantially vertical, lower leg 102 relative to the substantially vertical portion 109 of the upper leg 103, in one embodiment, can be adjusted via a plurality of leg extension apertures 112. Note that while one set of leg extension apertures is shown in FIG. 1, a complementary set of leg extension apertures could also be included on the opposite side of the substantially vertical portion 109 of the upper leg 103. The plurality of leg extension apertures 112 is located along the lower portion of the substantially vertical portion 109 of the upper leg 103 in this embodiment. In one embodiment, there are ten apertures included in the plurality of leg extension apertures 112. Other numbers of apertures will be obvious to those of ordinary skill in the art having the benefit of this disclosure.

In this illustrative embodiment, the substantially vertical, lower leg 102 includes a push button 113 that is spring biased outwardly from the substantially vertical, lower leg 102 by a spring 114. In this illustrative embodiment, one push button 113 extends outwardly from the substantially vertical, lower leg 102, while another push button is retained inside the interior of the substantially vertical, lower leg 102. Other mechanisms can be used in addition to, or instead of, a push button 113. For example, instead of the push button 113, a pin or a clip can also be used. Other mechanisms will be obvious to those of ordinary skill in the art having the benefit of this disclosure.

A user can push the push button 113 through an aperture 116 into the substantially vertical, lower leg 102 to telescope the substantially vertical, lower leg 102 into, and out of, the substantially vertical portion 109 of the upper leg 103. In one embodiment, when the push button 113 engages an uppermost aperture 117 of the plurality of leg extension apertures 112, the cane 100 retracts into a collapsed position. By contrast, when the push button 113 engages a lowermost aperture 118 of the plurality of leg extension apertures 112, the cane 100 extends to approximately forty inches in length.

When adjustment of the substantially vertical, lower leg 102 relative to the substantially vertical portion 109 of the upper leg 103 is desired, the user depresses the push button 113 inwardly to release the substantially vertical, lower leg 102 relative to the upper leg 103. The user then slides the substantially vertical, lower leg 102 to a desired position, which corresponds to one aperture of the plurality of leg extension apertures 112, and allows the push button 113 to protrude (or click) into a respective aperture of the plurality of leg extension apertures 112 to lock the substantially vertical, lower leg 102 relative to the upper leg 103. An optional stripped nut 119 can then be tightened to retain the substantially vertical, lower leg 102 to the substantially vertical portion 109 of the upper leg 103. Additionally, an optional plug 120 can be inserted into the substantially vertical, lower leg 102 to prevent the ingress of foreign objects such as dirt, dust, rocks, or insects into the substantially vertical, lower leg 102.

In one or more embodiments, the upper portion 101 can be selectively coupled to, and decupled from, a quadspider 121. In one or more embodiments, the quadspider 121 includes four legs 122,123 (two of which are shown in FIG. 1, with the others being shown in FIGS. 6-9), which extend from a substantially planar plate 124. In one or more embodiments, each of the legs 122,123 can be covered with a slip-resistant tip 126,127 configured to increase a friction coefficient between the quadspider 121 and a floor, street, or the ground. It should also be noted that the slip-resistant tip 126,127 can include, or can be replaced by, one or more metal prongs for use on ice or slippery surfaces.

In one or more embodiments, a cane-receiving conduit 125 defines a cylindrical channel that is mounted orthogonally in the substantially planar plate 124. The upper portion 101 of the cane 100 can be inserted into the cane-receiving conduit 125 to selectively couple the upper portion 101 of the cane 100 to the quadspider 121. An optional cylindrical rivet 131 can extend from an exterior side of the substantially vertical, lower leg 102 of the cane 100. As will be shown in more detail below with reference to FIG. 6, the cylindrical rivet 131 can engage an alignment receiver so that the upper portion 101 of the cane 100 is properly aligned with the quadspider 121 with the substantially horizontal portion 107 of the upper leg 103 extending distally between two legs 122 (and another hidden by 122) defining an acute angle, rather than between legs 122,123, which define an obtuse angle as will be shown in FIGS. 6-8.

When the upper portion 101 of the cane 100 is removed from the quadspider 121, it can be used as a conventional, single-tube cane in one or more embodiments. A slip-resistant tip can be applied to the lower leg 102 of the upper portion 101 of the cane 100 to increase a friction coefficient between the upper portion 101 of the cane 100 and a surface.

When it is desired to attach the upper portion 101 of the cane 100 to the quadspider 121, the lower leg 102 of the upper portion 101 of the cane 100 is inserted into the cane-receiving conduit 125. A winged finger screw 128 is then threaded into corresponding threads at the base of the lower leg 102 of the cane 100 to fixedly attach the lower leg 102 of the cane to the quadspider 121. Prior to inserting the winged finger screw 128 into the lower leg 102, a washer 130 and/or a lock washer 129 can be placed about the threaded portion of the winged finger screw 128 to keep its threads engaged with the complementary threads of the lower leg 102 in one or more embodiments.

In one or more embodiments, the orientation at which the substantially horizontal portion 107 of the upper leg 103 can be reversed using the push button 113. Thus, while the substantially horizontal portion 107 of the upper leg 103 is extending distally to the left in FIG. 1, it can be reversed so as to extend to the right by pressing the push button 113 into the lower leg 102 and rotating the substantially horizontal portion 107 of the upper leg 103 by 180-degrees. Where so configured, this allows the other push button 115 to extend through an aperture of the plurality of apertures 112. To accommodate this, in one or more embodiments the lower leg includes not only one aperture 116 in the lower leg 102, but a second aperture 132 as well.

In one or more embodiments, only one push button is accessible at any one time due to the fact that only a single vertical set of apertures, i.e., the plurality of apertures 112, is present on the substantially vertical portion 109 of the upper leg 103. In other embodiments, where apertures are included on both sides of the upper leg 103, both push button 113 and push button 115 would be accessible at the same time. The inclusion of only a single column of the plurality of apertures 112 reduces manufacturing costs by eliminating the need for another set of apertures. Additionally, it facilitates a stronger engagement of either push button 113 or push button 115 due to the fact that the spring 114 is compressed more tightly.

In one or more embodiments, a frictional coupler can be disposed between the substantially vertical, lower leg 102 and the substantially vertical portion 109 of the upper leg 103 to provide a frictional force between the two. However, in other embodiments this component will be omitted.

As described above, in one or more embodiments the substantially vertical, lower leg 102 includes a push button 113 that can protrude through one aperture of the plurality of leg extension apertures 112. When adjustment of the overall length is desired, the user depresses the push button 113 inwardly to release the substantially vertical, lower leg 102 relative to the substantially vertical portion 109 of the upper leg 103. The user then slides the substantially vertical, lower leg 102 to a desired position, which corresponds to a respective one of the plurality of leg extension apertures 112, and allows the push button 113 to protrude into a respective aperture to lock the substantially vertical, lower leg 102 relative to the substantially vertical portion 109 of the upper leg 103.

Optionally, a spring member for shock reduction to provide comfort for the user can be placed between the substantially vertical portion 109 of the upper leg 103 and the substantially vertical, lower leg 102. Where included, the spring member absorbs at least some force resulting from contact occurring between the slip-resistant tip 126,127 and a supporting surface.

Figure 2:
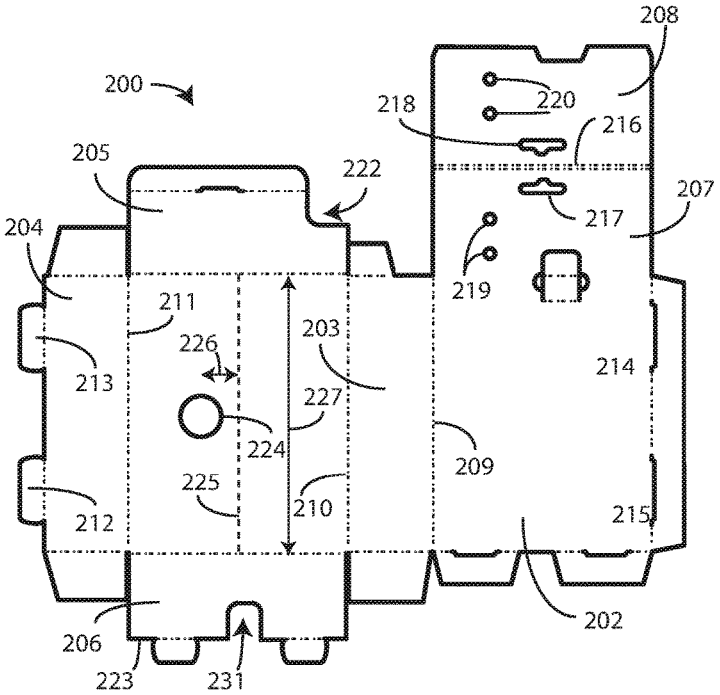
FIG. 2 illustrates one explanatory die cut package for a cane in accordance with one or more embodiments of the disclosure.

Turning now to FIG. 2, illustrated therein is one explanatory package 200 configured in accordance with one or more embodiments of the disclosure. The package 200 is shown as a die cut, which may be cut from a sheet of cardboard, stiff paperboard, paper, plastic, or other materials. In one embodiment, a die cuts the package 200 as a singular, integral component. In FIG. 2, the dark lines indicate cut locations, while the dashed lines indicate fold locations.

In one or more embodiments, the package 200 includes a front face 201 and a rear face 202. A first side face 203 and a second side face 204 connect the front face 201 to the rear face 202 when the package is assembled. For example, the first side face 203 and the rear face 202 can be folded relative to each other along fold line 209, while the first side face 203 and the front face 201 are folded relative to each other along fold line 210. The second side face 204 can then be folded relative to the front face 201 along fold line 211, with one or more flaps 212,213 engaging one or more insertion slits 214,215 to form a rectangular box. The upper face 205 and lower face 206 can be similarly folded, with corresponding flaps inserted, to define an enclosed rectangular box.

In one or more embodiments, a hang flap 207 extends distally from the rear face 202. In one embodiment, a hang flap reinforcer 208 then extends from the hang flap 207. The hang flap reinforcer 208 can be folded relative to the hang flap 207 along double fold lines 216 to double the amount of material being used to hang the package 200 where so desired. In one embodiment, the hang flap 207 includes a hanging mount aperture 217, with the hang flap reinforcer 208 including another hanging mount aperture 218 that is a mirror image of hanging mount aperture 217. Thus, when hang flap reinforcer 208 is folded relative to the hang flap 207 along double fold lines 216 to double the amount of material being used to hang the package 200, hanging mount aperture 217 and hanging mount aperture 218 overlap to form a single hanging mount aperture.

In one or more embodiments, additional apertures 219, 220 can be included in each of the hang flap reinforcer 208. These additional apertures 219,220 can be used, for example, to allow retention material, such as a zip-tie or twist-tie, to pass through to retain an upper portion (101) of a cane (100) within the package 200, as will be shown below with reference to FIG. 5. As with the hanging mount aperture 217 and the other hanging mount aperture 218, when the hang flap 207 and the hang flap reinforcer 208 are folded along double fold lines 216 to double the amount of material being used to hang the package 200, these other apertures 219,220 can overlap.

In one or more embodiments, the lower face 206 includes a peninsular aperture 221 that is centrally located along an edge 223 of the lower face 206. The peninsular aperture 221 is "peninsular" in that three sides of the peninsular aperture 221 are surrounded by the material of the lower face 206, while a fourth side is open and unbounded.

In one or more embodiments, the upper face 205 includes a two-sided aperture 222 at one of its upper corners. The two-sided aperture 222 is "two-sided" in that two sides of the two-sided aperture 222 are surrounded by the material of the upper face 205, while a two other sides (presuming the two-sided aperture 222 is a rectangular aperture) are each open and unbounded. In this illustrative embodiment, the two-sided aperture 222 is located on the upper, right side of the upper face 205. However, in another embodiment, the two-sided aperture 222 can be located on the upper, left side of the upper face 205.

In one or more embodiments, the front face 201 defines an aperture 224. In this illustrative embodiment, the aperture 224 comprises a circular aperture. However, in other embodiments the aperture 224 can be configured in other shapes. In this illustrative embodiment the aperture 224 is centrally located along a height 225 of the front face 201, which is about 4.25 inches from the top of the front face 201 and about 4.25 inches from the bottom of the front face 201 in one embodiment. While being centrally located along the height 225 of the front face 201, in this illustrative embodiment the aperture 224 is offset 226 from a medial line 227 defined at the middle of the front face 201. In illustrative embodiment, the aperture 224 is offset 226 from the medial line 227 by being to the left of the medial line 227. In another embodiment, the aperture 224 is offset 226 from the medial line 227 by being to the right of the medial line 227. In this illustrative embodiment, the aperture 224 is offset 226 from the medial line 227 by between one and two inches. However, it should be noted that the aperture 224 can be offset 226 from the medial line 227 by other distances as well.

In one or more embodiments, when assembled the package 200 has a length 2701 of about eight and a half inches, with a width of about 6.75 inches. Most drugstore and big-box retailers are more than willing to place packages 200 of this size on their shelves. Accordingly, by packaging a cane (100) in the package 200, this allows a user can see and select the cane (100) as an in-store, off-the-shelf purchase.

By contrast, prior art packages generally have—at their smallest—a height of over thirty inches. Retailers generally do not allow such package sizes to be placed on their shelves. Accordingly, embodiments of the present disclosure provide over a seventy-percent reduction in package height, advantageously allowing retailers to display previously undisplayable products on their shelves.

Figure 3:
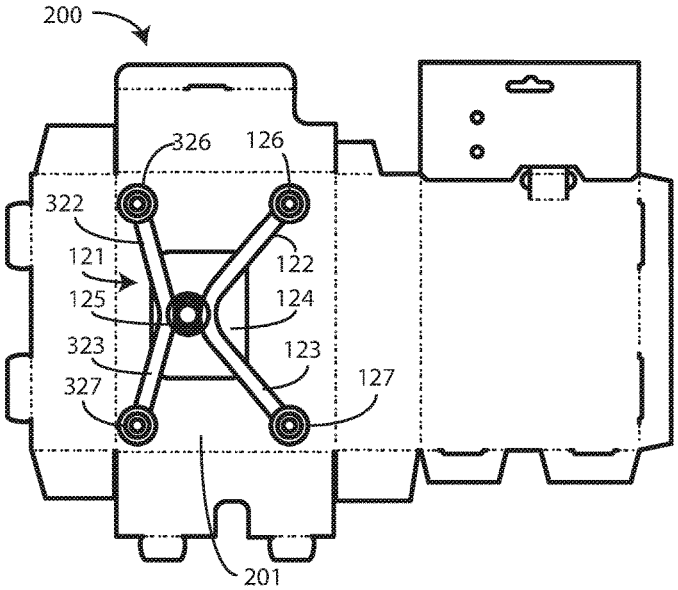
FIG. 3 illustrates one or more method steps for packaging an explanatory cane in accordance with one or more embodiments of the disclosure.
Figure 4:
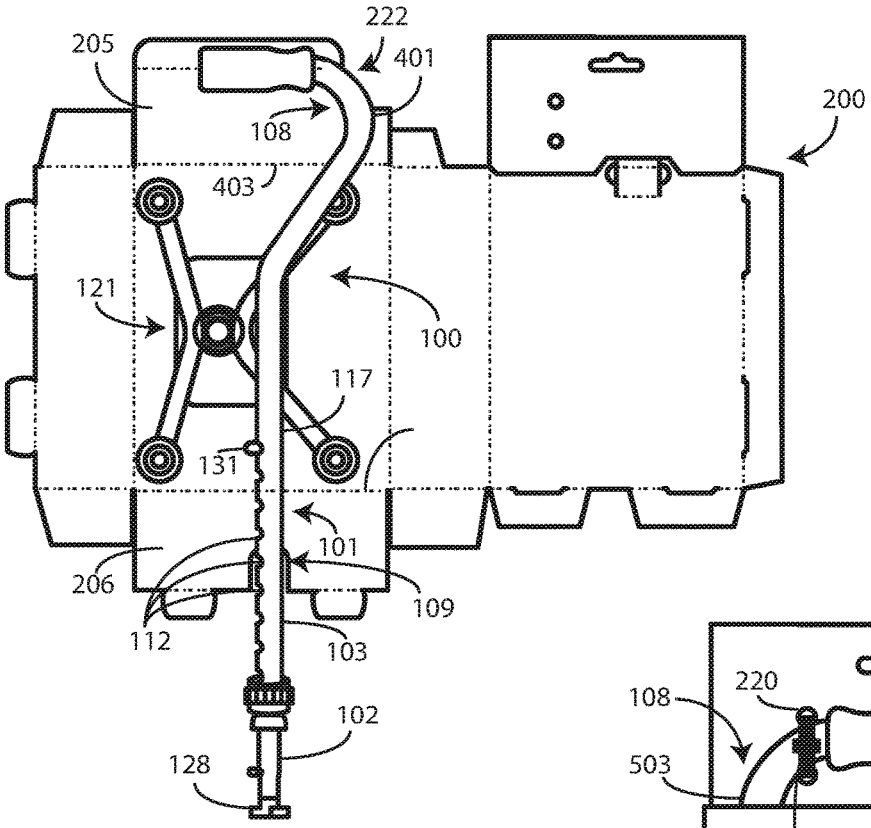
FIG. 4 illustrates one or more method steps for packaging an explanatory cane in accordance with one or more embodiments of the disclosure.

A cane (100) can be packaged within the package 200 by first detaching the upper portion (101) of the cane (100) from the quadspider (121). Turning now to FIGS. 3-4, illustrated therein are one or more method steps illustrating how this can occur.

Beginning with FIG. 3, the quadspider 121, after being detached from the upper portion (101) of the cane (100), can be placed into the package 200 with the substantially planar plate 124 abutting the interior surface of the front face 201. In one or more embodiments, this is done with the cane-receiving conduit 125 axially aligned with the aperture (224) defined by the front face 201 such that the aperture (224) concentrically circumscribes the cane-receiving conduit 125. This results in each of the four legs 122,123,322,323 extending upwardly from the front face 201 of the package, with the bottoms of the slip-resistant tips 126,127,326,327 being visible.

Moving to FIG. 4, the upper portion 101 of the cane 100 has been placed into the collapsed position. Specifically, the substantially vertical, lower leg 102 is fully inserted into the upper leg 103, with the push button 113 engaging the uppermost aperture 117 of the plurality of leg extension apertures 112. The winged finger screw 128 is threaded into corresponding threads at the base of the lower leg 102 of the cane 100, with the washer (130) and lock washer (129) placed about the threaded portion of the winged finger screw 128 to keep its threads engaged with the complementary threads of the lower leg 102.

The upper portion 101 of the cane 100 is then placed atop, and across, the bottom of the quadspider 121 with the apex 501 of the gooseneck 108 being aligned laterally with the two-sided aperture 222 of the upper face 205. The lower leg 102 of the cane 100 is then aligned with the peninsular aperture 221 of the lower face 206.

From this position, the lower face 206 can be folded upward along fold line 402 such that the peninsular aperture 221 captures the lower leg 102 of the crutch 100 on three sides. Similarly, the upper face 205 can be folded along fold line 403 such that the two-sided aperture 222 captures two sides of the apex 501 of the gooseneck 108. The remaining sides can then be folded as described above with reference to FIG. 2 such that the package 200 defines define an enclosed rectangular box about the quadspider 121 and a portion of the cane 100 extending from the apex 401 of the gooseneck 108 to within the substantially vertical portion 109 of the upper leg 103.

Figure 5:
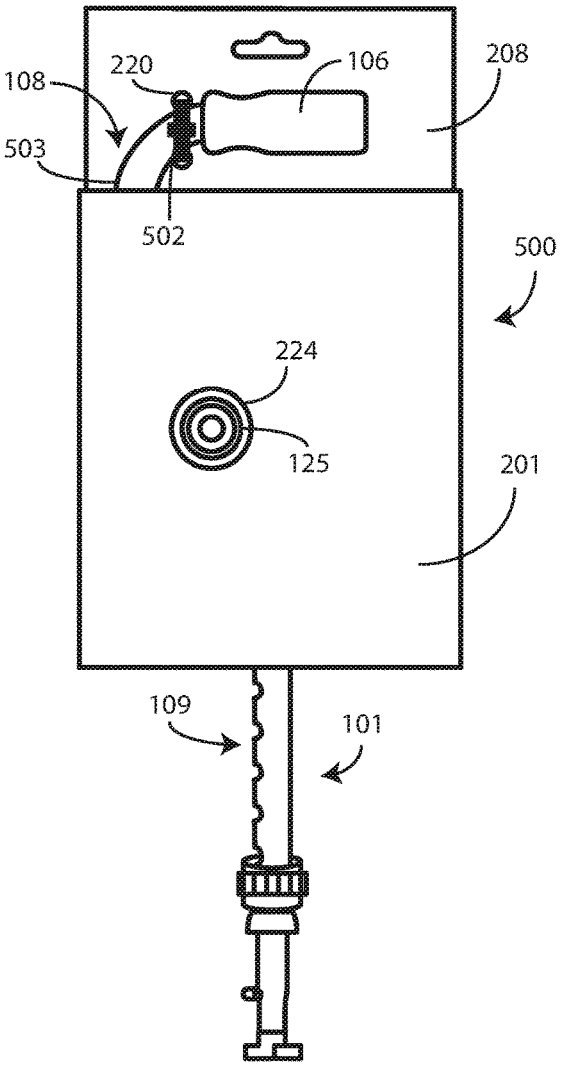
FIG. 5 illustrates one explanatory cane in a packaged state in accordance with one or more embodiments of the disclosure.

The resulting enclosed rectangular box is shown in FIG. 5. Turning now to FIG. 5, the enclosed rectangular box 500 has been turned over. As shown, the cane-receiving conduit 125 of the quadspider (121) is axially aligned with the aperture 224 defined by the front face 201. In this illustrative embodiment, the aperture 224 concentrically circumscribes the cane-receiving conduit 125. This results in the rest of the quadspider (121) being enveloped, enclosed, and surrounded by the various sides of the enclosed rectangular box 500.

In this illustrative embodiment, a part 502 of the gooseneck 108 disposed between the apex (401) and the substantially horizontal portion (107) of the upper portion 101 of the cane (100) is visible above the upper face (205) of the enclosed rectangular box 500. This occurs due to the fact that the gooseneck 108 is positioned within the two-sided aperture (222) arrests the gooseneck 108 between the two sides of the two-sided aperture (222), the rear face (202), and the first side face (203).

Similarly, a portion of the substantially vertical portion 109 of the upper portion 101 of the cane (100) extends distally from the lower face (206) of the enclosed rectangular box 500. This occurs due to the fact that the peninsular aperture (221) arrests the substantially vertical portion 109 of the upper portion 101 of the cane (100) between the three sides of the peninsular aperture (221) and the rear face (202).

In this illustrative embodiment, a zip tie 503 has been passed through the one or more apertures (219),220 disposed in the hang flap (207) and the hang flap reinforcer 208, respectively, to retain the gooseneck 108 of the upper portion 101 of the cane (100) against the hang flap reinforcer 208. In this configuration, the enclosed rectangular box 500 can be conveniently hung from a pegboard or other hook in a retail establishment. Alternatively, the enclosed rectangular box 500 can be placed on a shelf with the rear face (202) flat against the shelf.

The configuration shown in FIG. 5 provides an extremely compact packaging solution for the cane (100). For example, despite providing a cane (100) with a quadspider (121) that spans some fifty-seven square inches on the ground, with an upper portion 101 that can extend vertically up to forty inches when in the usage position, this same cane (100) can be packaged in the enclosed rectangular box 500 of FIG. 5, which occupies less than 155 cubic inches. This is incredibly small for full size canes, as prior art boxes can consume a whopping two thousand cubic inches.

Figure 6:
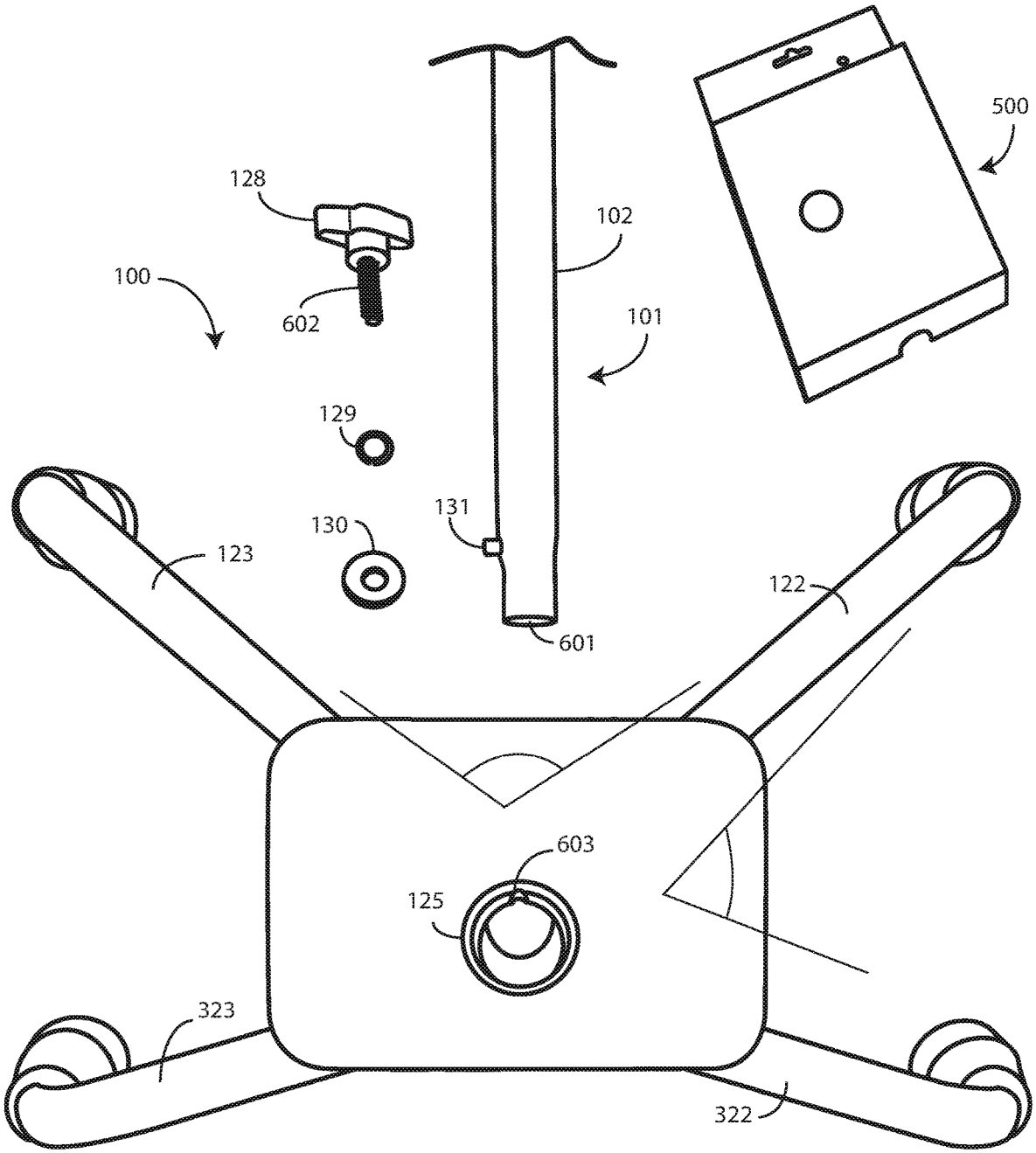
FIG. 6 illustrates one or more method steps for assembling an explanatory cane in accordance with one or more embodiments of the disclosure.

Turning now to FIG. 6, to assemble the cane 100, one first removes the upper portion 101 and the quadspider 121 from the enclosed rectangular box 500. The person then unscrews the winged finger screw 128 from the base 601 of the lower leg 102 of the upper portion 101 of the cane 100. As shown in FIG. 6, in this illustrative embodiment a washer 130 and lock washer 129 have been provided to keep the threaded portion 602 of the winged finger screw 128 engaged in the base 601 of the lower leg 102.

As shown in FIG. 6, the cane-receiving conduit 125 of the quadspider 121 includes an alignment receiver 603. When the lower leg 102 of the upper portion 101 of the cane 100 is inserted into the cane-receiving conduit 125, with the cylindrical rivet 131 extending from the exterior surface of the lower leg 102 of the upper portion 101 of the cane 100 is inserted into the alignment receiver 603, this provides a proper alignment of the upper portion 101 of the cane 100 with the quadspider 121.

In one or more embodiments, this proper alignment results in the substantially horizontal portion (107) of the upper leg (103) extending distally between two legs 122,322 defining an acute angle, rather than between legs 122,123, which define an obtuse angle. Of course, the substantially horizontal portion (107) of the upper leg (103) can be reversed so as to extend distally between legs 123,323 using the push buttons (113,115) as noted above. This allows the cane 100 to be used in either a left handed configuration, i.e., when the substantially horizontal portion (107) of the upper leg (103) extends distally between legs 123,323, or a right handed configuration, i.e., when the substantially horizontal portion (107) of the upper leg (103) extend distally between two legs 122,322.

Figure 7:
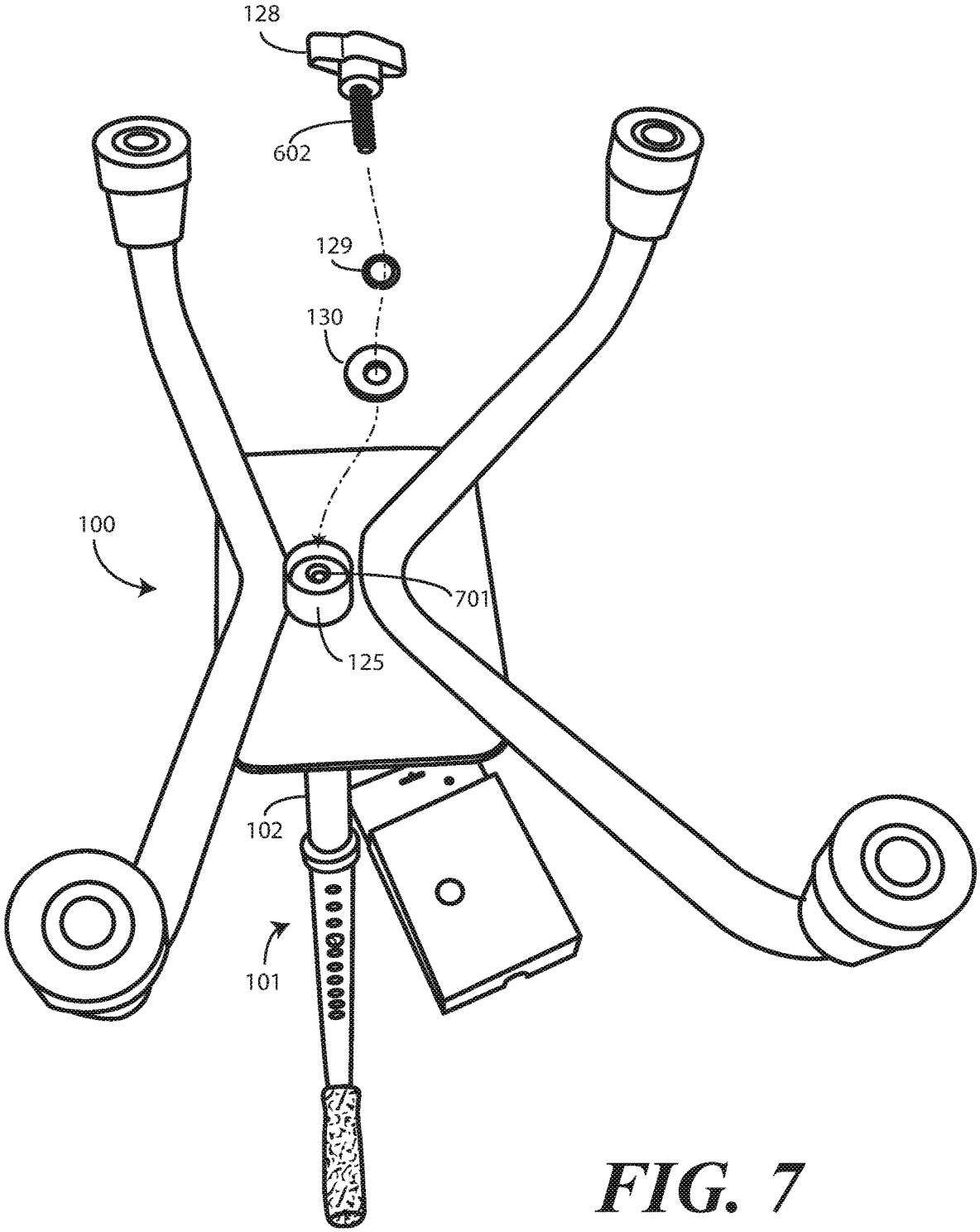
FIG. 7 illustrates one or more method steps for assembling an explanatory cane in accordance with one or more embodiments of the disclosure.

Turning now to FIG. 7, once the lower leg 102 of the upper portion 101 of the cane 100 is inserted into the cane-receiving conduit 125, with the cylindrical rivet (131) extending from the exterior surface of the lower leg 102 of the upper portion 101 of the cane 100 is inserted into the alignment receiver (603), the threaded portion 602 of the winged finger screw 128 can be threaded into a threaded receiver 701 disposed at the base of the lower leg 102 of the upper portion 101 of the cane 100. The threaded portion 602 of the winged finger screw 128 can optionally be passed through the washer 130 and/or lock washer 129 prior to threading the threaded portion 602 of the winged finger screw 128 into the threaded receiver 701 to ensure that the threaded portion 602 remains engaged with the threaded receiver 701 in one or more embodiments.

Figure 8:
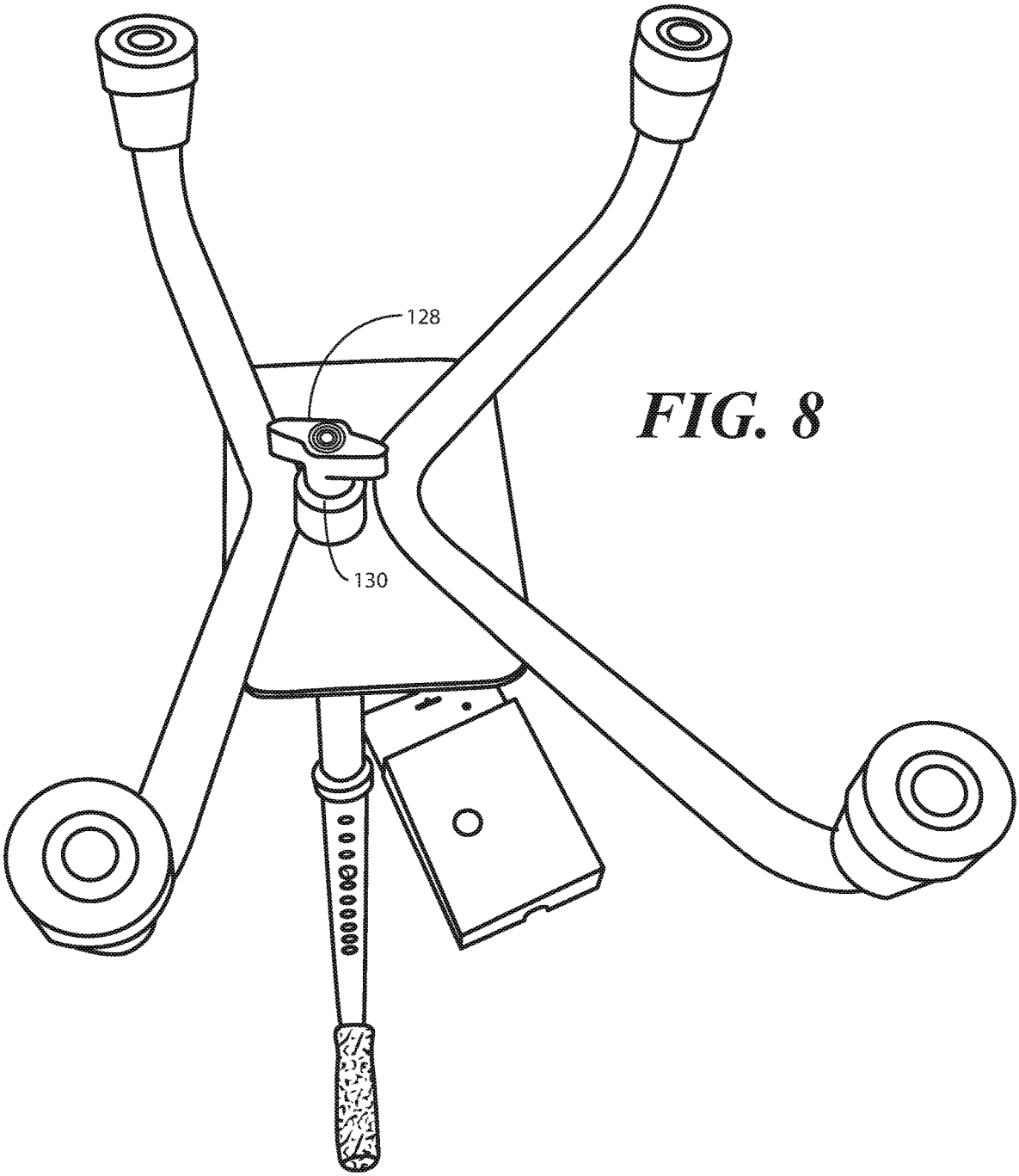
FIG. 8 illustrates one or more method steps for assembling an explanatory cane in accordance with one or more embodiments of the disclosure.
Figure 9:
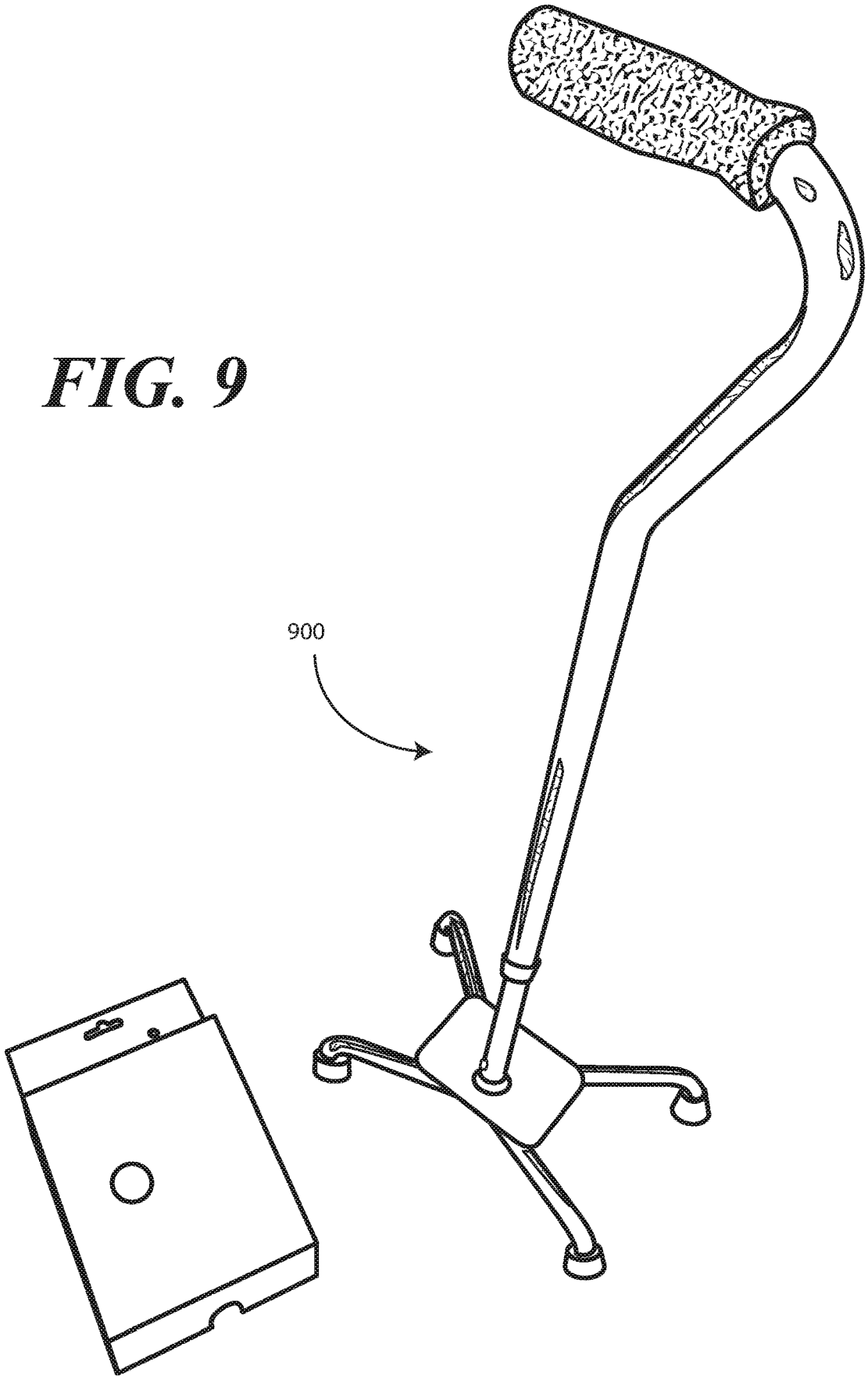
FIG. 9 illustrates one explanatory assembled cane in accordance with one or more embodiments of the disclosure.
Figure 10:
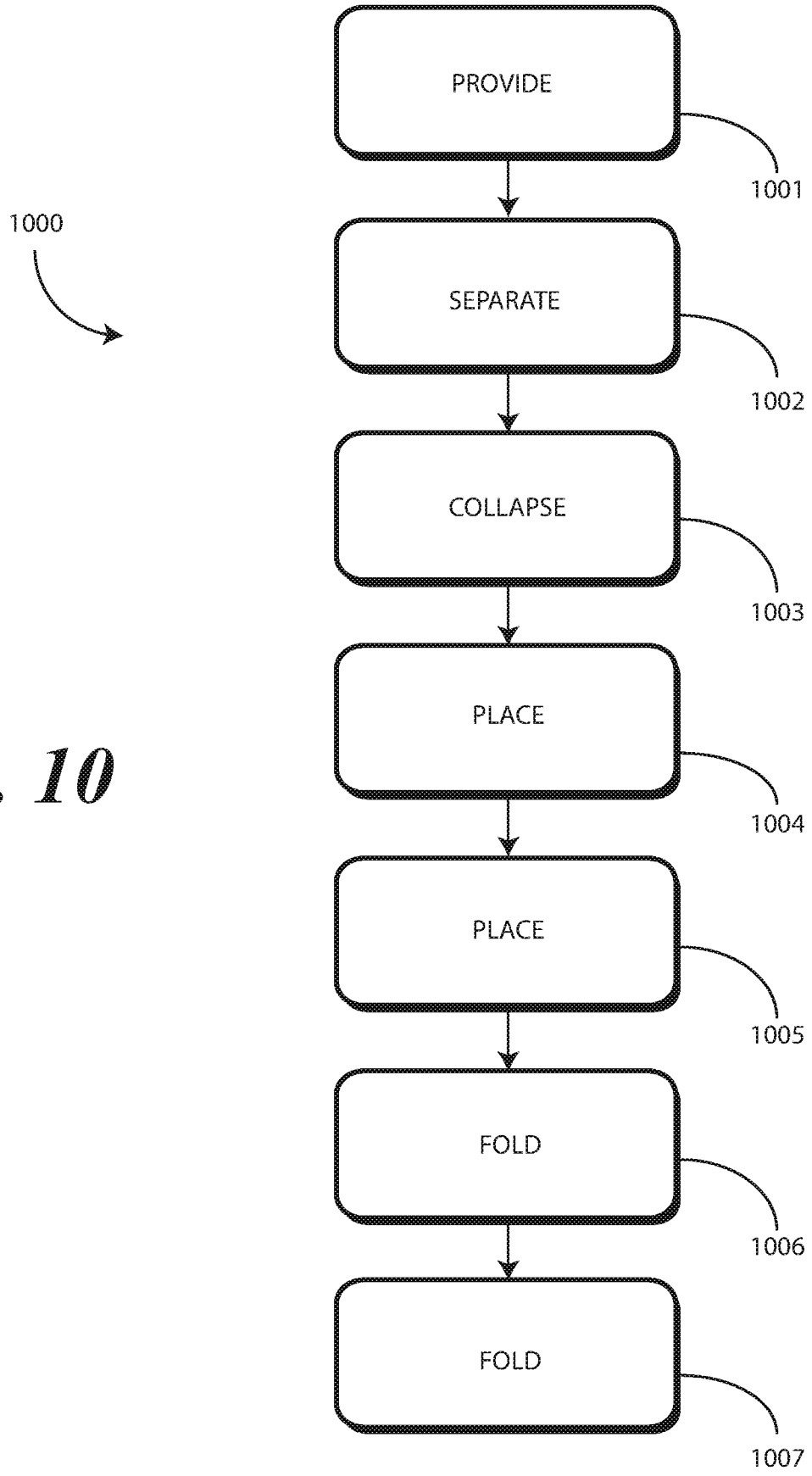
FIG. 10 illustrates one explanatory method in accordance with one or more embodiments of the disclosure.

Turning now to FIG. 8, the winged finger screw 128 can then be tightened such that the washer 130 and lock washer (129) engage to retain the winged finger screw 128 into the threaded receiver (701). As shown in FIG. 9, the fully assembled cane 900 is now ready for use.

Turning now to, illustrated therein is one method 1000 of packaging a selectively separable quad cane assembly in a package in accordance with one or more embodiments of the disclosure. As will be described, in one or more embodiments the method 1000 comprises placing a quadspider comprising a cane-receiving conduit disposed along a substantially planar plate against a front face of a package with the substantially planar plate abutting the package and the cane-receiving conduit positioned within an aperture of the front face. The method 1000 then includes placing an upper portion of the cane comprising a gooseneck and a lower leg atop and across a bottom of the quadspider with an apex of the gooseneck engaging an aperture in an upper face of the package and the lower leg engaging another aperture in a lower face of the package. The method 1000 concludes by folding the package to create an enclosed box. Optionally, the method 1000 can include coupling the gooseneck to a double-layer hanging flap, formed by folding a hanging flap reinforcer atop a hanging flap to create the double-layer hanging flap that extends from a rear face of the enclosed box, with a fastener such as a twist tie or zip-tie.

Beginning at step 1001, the method 1000 includes providing a cane (100) configured as described above with reference to FIG. 1. At step 1002, the method 1000 comprises separating a quadspider of the cane from an upper portion of the cane.

After initial manufacture, the quadspider and upper portion of the cane may be separate. Where this is the case, step 1002 may include inserting a threaded portion of a winged finger screw into a threaded receiver disposed at the base of the lower leg of the cane. The threaded portion of the winged finger screw can optionally be passed through the washer and/or lock washer at step 1002 prior to threading the threaded portion of the winged finger screw into the threaded receiver to ensure that the threaded portion remains engaged with the threaded receiver in one or more embodiments.

In other embodiments, the quadspider may be initially attached to the upper portion of the cane. Where this is the case, step 1002 can include removing a threaded portion of a winged finger screw from the threaded receiver disposed at the base of the lower leg of the cane and removing the lower leg from a cane-receiving conduit of the quadspider. Thereafter, step 1002 can optionally include inserting the threaded portion of a winged finger screw into the threaded receiver and/or passing the threaded portion through the washer and/or lock washer as previously described.

At step 1003, the method 1000 includes transitioning the upper portion of the cane to the collapsed configuration. In one or more embodiments, the collapsed configuration occurs where one or more push buttons of the lower leg of the upper portion of the cane engage an uppermost aperture of a plurality of leg insertion apertures disposed along an upper leg that telescopically engages the lower leg, with the lower leg is fully inserted into the upper leg.

At step 1004, after being detached from the upper portion of the cane, the method 1000 includes placing the quadspider into the package with a substantially planar plate of the quadspider abutting an interior surface of the front face of the package. In one or more embodiments, step 1004 comprises positioning a cane-receiving conduit within an aperture located on the front face of the package. In one or more embodiments, when this occurs the cane-receiving conduit becomes axially aligned with the aperture defined by the front face such that the aperture concentrically circumscribes the cane-receiving conduit.

At step 1005, the method 1000 comprises placing the upper portion of the cane atop, and across, the bottom of the quadspider. In one embodiment, step 1005 includes aligning an apex of the gooseneck of the upper portion of the cane laterally with an aperture located in an upper face of the package. In one embodiment, this aperture comprises a two-sided aperture. In one embodiment, step 1005 also includes aligning a lower leg of the cane with an aperture located in a lower face of the package. In one embodiment, this aperture comprises a peninsular aperture disposed along an edge of the lower face.

At step 1006, the method 1000 includes folding the package to define an enclosed box, which is rectangular in one embodiment. For example, step 1006 can include folding the lower face upward along a fold line such that the peninsular aperture captures the lower leg of the crutch on three sides. Similarly, step 1006 can include folding the upper face along another fold line such that the two-sided aperture captures two sides of the apex of the gooseneck. The remaining sides can then be folded as described above with reference to FIG. 2 such that the package defines define an enclosed rectangular box about the quadspider and a portion of the cane extending from the apex of the gooseneck to within the substantially vertical portion of the upper leg.

At step 1007, the method 1000 optionally includes further comprising folding a hanging flap reinforcer atop a hanging flap to create a double-layer hanging flap extending from a rear face of the enclosed box. At step 1008, the method 1000 optionally includes coupling the gooseneck to the double-layer hanging flap with a fastener. For example, a twist-tie or zip-tie can be threaded through apertures in the double-layer hanging flap extender and passed about the gooseneck to secure the gooseneck to the double-layer hanging flap, and so forth.

Figure 11:
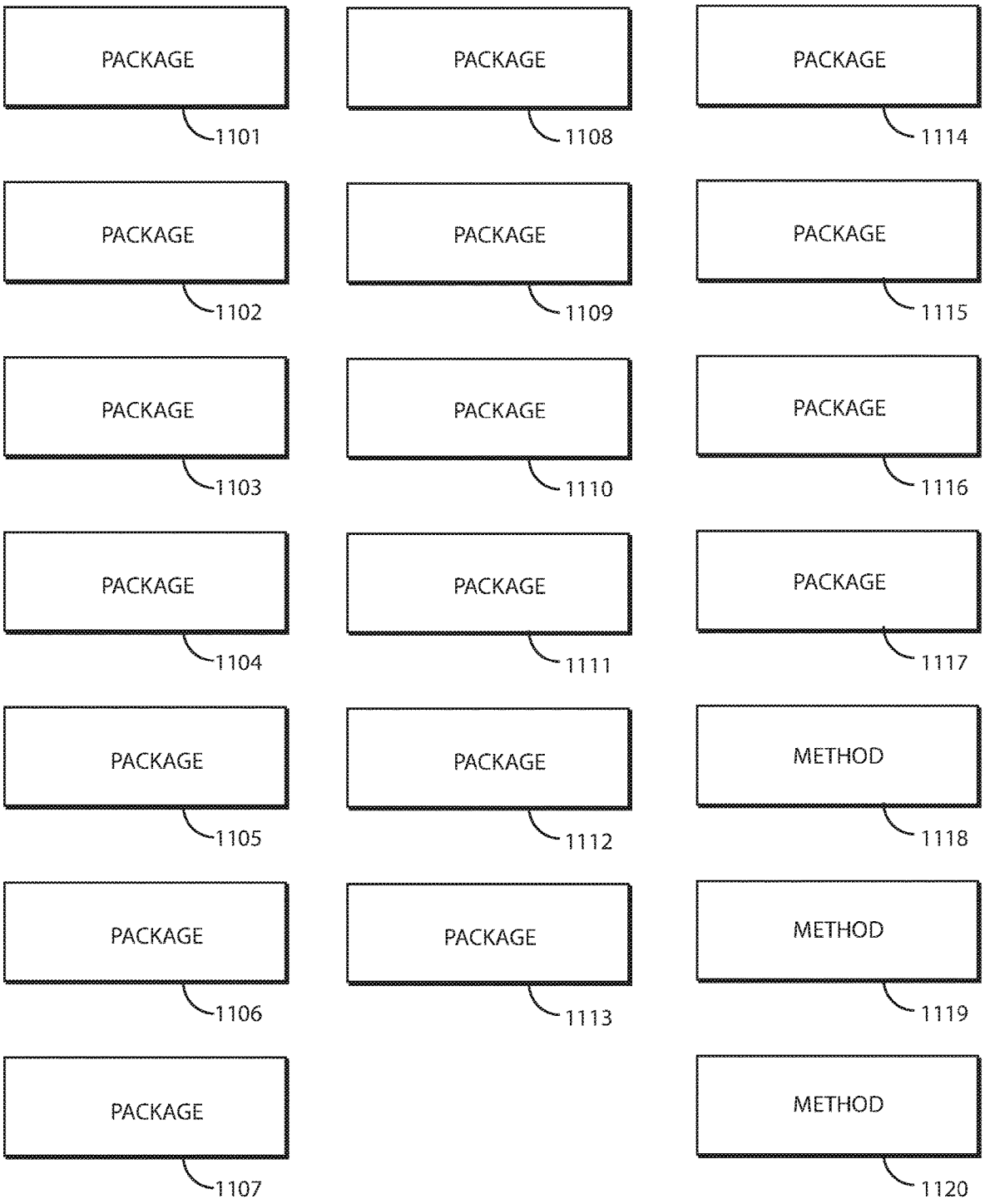
FIG. 11 illustrates various embodiments of the disclosure.

Turning now to FIG. 11, illustrated therein are various embodiments of the disclosure. At 1101, a package for a selectively separable quad cane assembly comprises a front face, a rear face, a first side face, a second side face, a top face, and a lower face. At 1101, the front face defines an aperture that is centrally located along a height of the front face, and offset from a medial line defined by the front face. At 1101, the upper face defines a two-sided aperture at a corner of the upper face. At 1101, the lower face defines a peninsular aperture that is centrally located along an edge of the lower face.

At 1102, the package of 1101 further comprises a hang flap extending distally from the rear face. At 1103, the package of 1102 further comprises a hang flap reinforcer extending distally from the hang flap.

At 1104, the hang flap of 1103 further defines a hanging mount aperture, while the hang flap reinforcer defining another hanging mount aperture. At 1104, the another hanging mount aperture comprises a mirror image of the hanging mount aperture about a double fold line defined between the hang flap and the hang flap reinforcer. At 1105, the hang flap reinforce of 1104 is folded along the double fold line such that the hanging mount aperture and the another hanging mount aperture overlap.

At 1106, the first side face of 1101 is coupled to the rear face at a first fold line. At 1106, the first side face of 1101 is coupled to the front face at a second fold line. At 1107, the second side face of 1106 is coupled to the front face at a third fold line. At 1108, the package of 1107 further comprises one or more flaps extending distally from the second side face. At 1108, an edge of the rear face defines one or more insertion slits.

At 1109, the package of 1101 further comprises a quadspider having a substantially planar plate abutting an interior surface of the front face. At 1110, the quadspider of 1109 comprises a cane-receiving conduit disposed along the substantially planar plate. At 1110, the aperture concentrically circumscribes the cane-receiving conduit.

At 1111, the package of 1110 further comprises an upper portion of a cane placed atop and across a bottom of the quadspider. At 1112, the upper portion of the cane of 1111 comprises a gooseneck having an apex aligned with the two-sided aperture of the upper face. At 1113, the upper portion of the cane of 1112 comprises a lower leg telescopically engaging an upper leg. At 1113, the lower leg is aligned with the peninsular aperture of the lower face.

At 1114, a package for a selectively separable quad cane assembly comprises an enclosed rectangular box. At 1114, the enclosed rectangular box comprises a front face defining an aperture that is centrally located along a height of the front face and offset from a medial line defined by the front face. At 1114, the enclosed rectangular box comprises an upper face defining a two-sided aperture at a corner of the upper face, and a lower face defining a peninsular aperture that is centrally located along an edge of the lower face.

At 1114, the package comprises the selectively separable quad cane assembly as well. At 1114, the selectively separable quad cane assembly comprises an upper portion defining a gooseneck and a lower leg telescopically engaging an upper leg. At 1114, the selectively separable quad cane assembly comprises a quadspider. At 1114, the quadspider comprises comprising a cane-receiving conduit disposed along a substantially planar plate.

At 1114, the aperture concentrically circumscribes the cane-receiving conduit. At 1114, an apex of the gooseneck is aligned with the two-sided aperture of the upper face. At 1114, the lower leg is aligned with the peninsular aperture of the lower face.

At 1115, the package of 1114 comprises at least one hang flap extending from a side of the enclosed rectangular box. At 1116, the at least one hang flap of 1115 defines one or more apertures. At 1116, the package further comprises a retention device passing through the one or more apertures and retaining the gooseneck against the hang flap.

At 1117, the upper leg of 1114 defines a plurality of apertures. At 1117, the lower leg comprises one or more push buttons that are spring biased outwardly from the lower leg. At 1117, the one or more push buttons are operable to engage an uppermost aperture of the plurality of leg insertion apertures when in a collapsed position where the lower leg is fully inserted into the upper leg. At 1117, the cane is in the collapsed position.

At 1118, a method of packaging a selectively separable quad cane assembly in a package comprises placing a quadspider of the selectively separable quad cane assembly. At 1118, the quadspider comprises a cane-receiving conduit disposed along a substantially planar plate. At 1118, the substantially planar plate is placed against a front face of the package with the substantially planar plate abutting the package and the cane-receiving conduit positioned within an aperture of the front face.

At 1118, the method comprises placing an upper portion of the selectively separable quad cane assembly comprising a gooseneck and a lower leg atop and across a bottom of the quadspider with an apex of the gooseneck engaging an aperture in an upper face of the package and the lower leg engaging another aperture in a lower face of the package. At 1118, the method includes folding the package to create an enclosed box.

At 1119, the method of 1118 comprises folding a hanging flap reinforcer atop a hanging flap to create a double-layer hanging flap extending from a rear face of the enclosed box. At 1120, the method of 1119 comprises coupling the gooseneck to the double-layer hanging flap with a fastener.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A package for a selectively separable quad cane assembly, the package comprising:

a box, comprising:

a front face;

a rear face;

a first side face;

a second side face;

a upper face; and a lower face;

wherein:

the front face defines an aperture that is centrally located along a height of the front face, and offset from a medial line defined by the front face;

the upper face defines a two-sided aperture at a corner of the upper face; and the lower face defines a peninsular aperture that is centrally located along an edge of the lower face; and a separable quad cane assembly at least partially enclosed by the box.

2. The package of claim 1, further comprising a hang flap extending distally from the rear face.

3. The package of claim 2, further comprising a hang flap reinforcer extending distally from the hang flap.

4. The package of claim 3, the hang flap defining a hanging mount aperture, the hang flap reinforcer defining another hanging mount aperture, the another hanging mount aperture comprising a mirror image of the hanging mount aperture about a double fold line defined between the hang flap and the hang flap reinforcer.

5. The package of claim 4, wherein the hang flap reinforcer is folded along the double fold line such that the hanging mount aperture and the another hanging mount aperture overlap.

6. The package of claim 1, wherein the first side face is coupled to the rear face at a first fold line, and is coupled to the front face at a second fold line.

7. The package of claim 6, wherein the second side face is coupled to the front face at a third fold line.

8. The package of claim 7, further comprising one or more flaps extending distally from the second side face, wherein an edge of the rear face defines one or more insertion slits.

9. The package of claim 1, the separable quad cane cane assembly comprising a quadspider having a substantially planar plate abutting an interior surface of the front face.

10. The package of claim 9, wherein the quadspider comprises a cane-receiving conduit disposed along the substantially planar plate, wherein the aperture concentrically circumscribes the cane-receiving conduit.

11. The package of claim 10, further comprising an upper portion of a cane placed atop and across a bottom of the quadspider.

12. The package of claim 11, wherein the upper portion of the cane comprises a gooseneck having an apex aligned with the two-sided aperture of the upper face.

13. The package of claim 12, wherein the upper portion of the cane comprises a lower leg telescopically engaging an upper leg, wherein the lower leg is aligned with the peninsular aperture of the lower face.

14. A package and a selectively separable quad cane assembly, the package comprising:

an enclosed rectangular box, comprising:

a front face defining an aperture that is centrally located along a height of the front face and offset from a medial line defined by the front face;

an upper face defining a two sided aperture at a corner of the upper face; and a lower face defining a peninsular aperture that is centrally located along an edge of the lower face; and the selectively separable quad cane assembly comprising:

an upper portion defining a gooseneck and a lower leg telescopically engaging an upper leg; and a quadspider comprising a cane-receiving conduit disposed along a substantially planar plate;

wherein:

the aperture concentrically circumscribes the cane-receiving conduit;

an apex of the gooseneck is aligned with the two-sided aperture of the upper face; and the lower leg is aligned with the peninsular aperture of the lower face.

15. The package of claim 14, further comprising at least one hang flap extending from a side of the enclosed rectangular box.

16. The package of claim 15, the at least one hang flap defining one or more apertures, further comprising a retention device passing through the one or more apertures and retaining the gooseneck against the hang flap.

17. The package of claim 14, the upper leg defining a plurality of apertures, the lower leg comprising one or more push buttons that are spring biased outwardly from the lower leg, the one or more push buttons operable to engage an uppermost aperture of the plurality of leg insertion apertures when in a collapsed position where the lower leg is fully inserted into the upper leg, wherein the cane is in the collapsed position.

* * * * *